United States Patent [19]

Whitney

[11] 4,254,902

[45] Mar. 10, 1981

[54] CONTAINER ASSEMBLY

[76] Inventor: Ruby D. Whitney, 672 - 41st St., Sarasota, Fla. 33580

[21] Appl. No.: 79,347

[22] Filed: Sep. 27, 1979

[51] Int. Cl.[3] ..... B65D 5/48

[52] U.S. Cl. ..... 229/28 R; 229/15; 206/561; 493/90

[58] Field of Search ..... 229/87.5, 28 R, 30; 150/32, 52 R; 206/561; 93/1 D

[56] References Cited

U.S. PATENT DOCUMENTS

| | | | |
|---|---|---|---|
| 1,430,720 | 10/1922 | Bowerman | 229/30 |
| 1,466,326 | 8/1923 | Wirz | 229/28 R |
| 2,403,901 | 7/1946 | Belanger | 229/28 R |
| 2,841,055 | 7/1958 | Denison | 93/1 D |

*Primary Examiner*—Joseph Man-Fu Moy
*Attorney, Agent, or Firm*—Arthur W. Fisher, III

[57] ABSTRACT

A container assembly for food items and like comestibles comprising a flexible fabric forming a plurality of sheets which in turn define a base wherein the sheets are disposed in stacked array and interconnected by a plurality of seams disposed in offset relation. A plurality of connector elements are connected in predetermined relation to the outermost sheet and structured for attachment to one another in a manner which will form pockets or compartments between the interconnected plurality of sheets and the specifically placed seams innerconnecting said sheets.

1 Claim, 3 Drawing Figures

FIG. 1
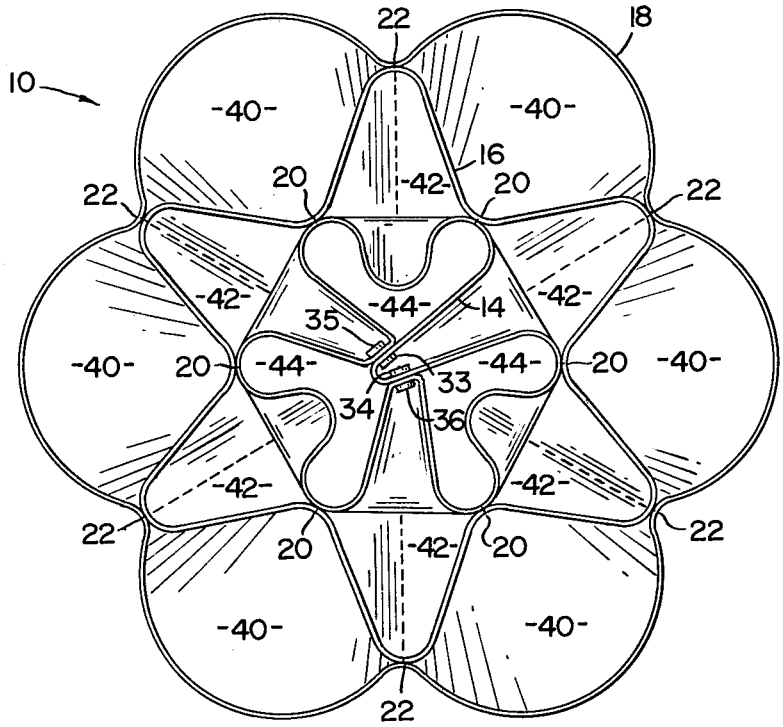
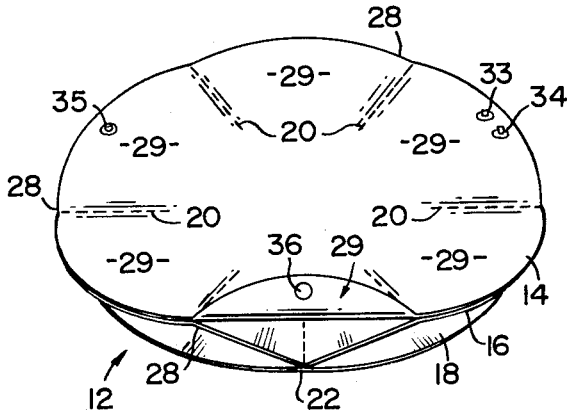
FIG. 2
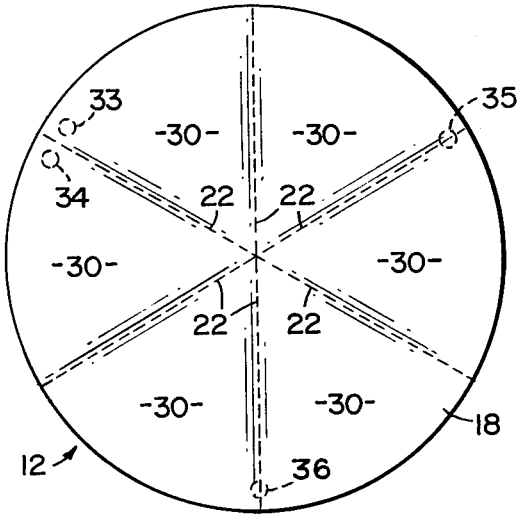
FIG. 3

CONTAINER ASSEMBLY

CROSS REFERENCE TO RELATED APPLICATIONS

The inventor herein listed is the inventor of U.S. Pat. No. Des. 166,894 and Assignor of U.S. Pat. No. 2,841,055. Both of the above-noted patents relate to a container and machine method for making containers of the same category of the present invention.

BACKGROUND OF THE INVENTION

1. Field of the Invention

This invention relates to a container for food products and/or like comestibles which is both decorative and practical in the display and support of such objects. The container is formed from a cloth, plastic or flexible material base formed of a plurality of sheet elements which, when interconnected to one another to find a plurality of pockets for object storage.

2. Description of the Prior Art

Container assemblies of the type used to hold and display food and comestible items in an attractive manner have been known for some time.

U.S. Pat. No. Des. 166,894 discloses a container of the category which may be stored in a flat or folded over relation and assembled through interconnection of the various portions of the container in a manner to form a plurality of pockets.

These pockets are specifically dimensioned and arranged in a decorative fashion so as to hold various types of comestibles in an attractive manner for display and access. Also note U.S. Pat. No. 2,841,055 as disclosing a machine and method of forming containers of the category described.

Other prior art structures are disclosed in the following U.S. Pat. Nos. Des. 23,086; Des. 55,188; Des. 109,607; Des. 648,182; and 2,535,219.

However, there is a desire need for a variation in structure of a container of the category described wherein such variation allows for a variation in the pockets and a different display in that defined in the structures of the aforementioned patents.

SUMMARY OF THE INVENTION

The subject container assembly is directed to the holding and displaying of comestible items in an asthetic and attractive array. More specifically, a base means formed from a plurality and at least three sheet elements are interconnected to one another to form a plurality of open pockets. Such pockets are formed into an open orientation when connector elements comprising the connector means are interconnected to one another in a predetermined relationship.

More specifically, the preferably three sheet elements comprise an outer sheet, a middle sheet and an under sheet. The middle sheet is interconnected to both the outer and under sheet at offset location and along predisposed seams. These seams are disposed in a diagonal or radial orientation on the under sheet and outer sheet respectively and the diposition of each pair of seams define segments on each of the outer and under sheet elements.

An important structure feature of the present invention is the placement of connector means. In the present invention, the connector means comprises a plurality of connector elements wherein a first and second connector element are disposed in side-by-side immediately adjacent relation to one another on the exposed surface of the outer sheet. More specifically, these two first and second connector elements are disposed within the same segment boundary.

A third connector element and a fourth connector element are also mounted on the exposed surface of the outer sheet element in spaced apart relation to one another and to the pair of first and second connector elements. Each of the third and fourth connector elements is disposed in a separate segment wherein each of the respective segments are disposed in spaced apart relation from one another and from the segment containing the first and second connector element.

While the specific structural features of each of the connector elements may vary and be defined by snap elements, adhesive tabs, and like interconnecting members, it is important to note that the first and third connector elements are structured for interengagement in connection to one another wherein the second and fourth connector elements are similarly structured for interengagement with one another. When all the connector elements are interconnected to the respective ones in the intended fashion, a substantially symetrical array of segregated pockets are formed. The plurality of pockets are defined by a first group of pockets arranged continuous end-to-end relation defined between the under and middle sheet elements. A second group of pockets are defined between the outer and middle sheets and also arranged in a continuous end-to-end relation. Seam portions or seams served to define the endwise boundaries of each of the pockets defining the first and second group of pockets and similarly define the junctions between adjacently positioned pockets in the first and second groups. A third group of pockets is also present and is defined by the exposed surface of the outer sheet element being folded essentially upon itself as the various connector elements are attached to one another as set forth above.

In the above fashion, the structure of the present invention is thereby formed into an open position further defining a container having a plurality of segregated pockets into which numerous type comestible objects may be placed for a display and access.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top plane view of the container in open position showing the relative positions of the various plurality of pockets.

FIG. 2 is a prospective view of the container and the base means thereof in its flat or closed or stored position.

FIG. 3 is an under view of the under sheet element defining a portion of the base means.

Similar reference characters refer to similar parts throughout the several views of the drawings.

DETAILED DESCRIPTION OF THE PREFERRED EMBODIMENT

As shown in FIG. 1, the container assembly of the present invention is represented as 10 and FIGS. 2 and 3 comprises a base means 12 formed from a plurality of sheet elements and preferably three sheet elements. These sheet elements may further be defined by an outer sheet element 14, a middle sheet element 16, and an under sheet element 18.

With reference to FIGS. 2 and 3, each of the sheet elements are interconnected by virtue of the outer sheet element 14 and the under sheet element 18 being secured to the middle sheet element 16. More specifically, attaching means in the form of a plurality of seams are disposed in secured relation on the outer sheet 14 as at 20, and on the under sheet as at 22.

The seams 20 comprise a first group of seams disposed in interconnected relation between the outer sheet 14 and middle sheet 16 so as to connect the later two sheet elements along the seam lines 20.

With reference to FIG. 2, the seams 20 extend radially from the outer periphery of the base means as at 28 toward the center thereof.

With regard to FIG. 3, the plurality of seams 22 comprise a second group of seams diametrically arranged on the under sheet and serving to interconnect the under sheet to the middle sheet along these diagonally disposed seam lines. It should be further noted that the seams 20 and 22 are disposed in offset relation to one another. Accordingly, both the outer sheet 14 and under sheet 18 are divided into a plurality of segments 29 and 30 respectively.

With reference to FIG. 1, the placement of the seams and the attendant interconnection of the outer, middle and under sheet elements define a plurality of pockets, to be described hereinafter when the connecting means of the present invention is attached in interconnected relation to one another. More specifically, with reference to FIG. 2, the connecting means comprises a plurality of connector elements including at least a first connector element 33, a second connector element 34, and a fourth connector element 36. It should be further noted that connector elements 33 and 34 are disposed within the same segment 29 prime while the third and fourth connector elements 35 and 36 are disposed within separate and spaced apart segments as clearly shown in FIG. 2. The segments containing connector elements 35 and 36 are separated by at least one other segment from each other and one other segment from segment 29 prime containing the connector elements 33 and 34.

With regard to the pockets defined by the interconnected sheet element, references made to FIG. 1. The plurality of pockets are at least partially defined by a first group of pockets 40 disposed in spaced apart relation to one another in a continuous fashion about the outer periphery of the container assembly 10. The ends of each pocket 40 are further defined by seams 22 interconnecting the under and the middle sheet elements.

The plurality of pockets are further defined by a second group of pockets 42 which are defined in an annular fashion in a continuous relation to one another and also in an end-to-end orientation between the outer sheet and the middle sheet as shown. The ends of each pocket 42 are further defined by seam portions 20.

Finally, the plurality of pockets are defined by a third group of pockets 44 which are defined on the interior of the first and second group of pockets and defined by the exposed surface of the outer sheet when the connector elements are interconnected to one another.

The position of the container assembly as shown in FIG. 1 represents its open condition defined by the attachment of each the connector elements to predetermined other ones of the connector elements as set forth above. In this open position, comestible items are capable of being mounted within the various pockets 40, 42 and/or 44, in an attractive array.

It will thus be seen that the objects set forth above, among those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language might be said to fall therebetween.

Now that the invention has been described, what is claimed is:

1. A container assembly primarily designed to hold comestible objects for display and access, said container assembly comprising: base means including a plurality of sheet elements disposed in interconnected, stacked array and having a common central axis, each sheet element including a plurality of segments, attaching means comprising seam elements secured in interconnecting relation between any two next adjacent sheet elements, said plurality of segments each at least partially defined by two spaced apart of said seam elements disposed to extend generally from the outer periphery of the base means toward said central axis, connector means mounted on the outermost of said sheet elements and disposable in connected relation to one another to define an open position, said open position defined by a plurality of formed and open pockets disposed in object holding position, said plurality of sheet elements comprises at least an outer sheet, an under sheet, and a middle sheet, said middle sheet disposed between said inner sheet and outer sheet, said seam elements disposed in innerconnected relation between said outer and middle sheets and said under and middle sheets in offset relation to one another to define said plurality of pockets, said plurality of the seam elements comprises a first group of seams secured and disposed diametrically to said under sheet in innerconnected relation to said middle sheet and defining a plurality of segments on the exposed surface of said under sheet, each segment disposed between two radial portions of said diametrically disposed seams, said plurality of seam elements comprises a second group of seams radially disposed and secured to said outer sheet and innerconnected to said middle sheet, said second group of seams defining a segment between each two of said seams on said outer sheet, said plurality of pockets are defined by a first group of pockets disposed between said under and middle sheets and positioned in continuous end-to-end relation, each of said group of pockets at least partially defined and innerconnected by consecutive, spaced apart radial portions of said first group of seams, said plurality of pockets are defined by a second group of pockets disposed between said outer and middle sheets and positioned in continuous end-to-end relation, each of said second group of pockets at least partially defined and innerconnected by consecutive, spaced apart seams of said second group of seams, said plurality of pockets comprise a third group of pockets each defined by the exposed surface of said outer sheet element attached to itself by innerconnection of said connector means, said first, second and third groups of pockets are disposed in offset relation to one another and wherein each pocket of each group is opened in object receiving and storing position upon innerconnection of said connector means, said outer sheet comprises a plurality of segments disposed radially to one another, and each disposed between two next adjacent spaced apart seam elements, said container means comprising at least a first and second connector element disposed in an adjacent, side-by-side relation within the same segment and at least a third and fourth connector element, each of which are disposed in separate ones of said segments symmetrical relation to said first and second connector element said plurality of connector elements are structured for attachment to other ones of said connector elements, wherein said the innerconnection of respective connector elements define said open position of said container, said first and second connector elements are structured for attachment respectively to said third and fourth connector element, said third and fourth connector element each mounted in a segment spaced apart from one another and spaced apart from the segment in which said first and second connector elements are mounted.

* * * * *